US005961398A

United States Patent [19]

McMillan

[11] Patent Number: 5,961,398

[45] Date of Patent: Oct. 5, 1999

[54] GOLF CLUB HEAD APPARATUS

[76] Inventor: Dean Edward McMillan, 3276 Grovepark Dr., Grove City, Ohio 43123

[21] Appl. No.: 09/131,615

[22] Filed: Aug. 10, 1998

Related U.S. Application Data

[60] Provisional application No. 60/058,496, Sep. 11, 1997.

[51] Int. Cl.[6] ..... A63B 69/36; A63B 53/04

[52] U.S. Cl. ..... 473/327; 473/340; 473/341; 473/228; 473/253; D21/735; D21/742; D21/748

[58] Field of Search ..... 473/228, 341, 473/324, 327, 328, 340, 253; D21/735, 742, 748

[56] References Cited

U.S. PATENT DOCUMENTS

| | | | |
|---|---|---|---|
| D. 274,448 | 6/1984 | Turza et al. . | |
| D. 326,887 | 6/1992 | Schuler . | |
| D. 360,008 | 7/1995 | Solheim . | |
| D. 367,095 | 2/1996 | Snyder . | |
| D. 367,691 | 3/1996 | Lee et al. . | |
| 5,470,070 | 11/1995 | Bendo | 473/341 X |

*Primary Examiner*—George J. Marlo

[57] ABSTRACT

A golf club head apparatus includes a ball-striker face portion and a main body portion underlying the ball-striker face portion. The ball-striker face portion is in a form of an automobile rear view mirror. The main body portion includes a top body surface and a bottom body surface, and the main body portion includes a pair of air foil surfaces. A handle is connected to the main body portion. The handle enters the main body portion through the top body surface which can be a simulated trunk lid. The handle is closer to a first air foil surface than to a second air foil surface in the pair of air foil surfaces. With the handle present, a complete golf club, such as a putter, is provided. Generally, the main body portion has a configuration which simulates a rear portion of an automobile. Alternatively, the main body portion has a configuration which simulates a front portion of an automobile. The pair of air foil surfaces are simulated automobile tail fin surfaces. A pair of simulated exhaust pipes project rearward from the main body portion. A simulated trunk lid is located between the first air foil surface and the second air foil surface on the main body portion. First and second simulated tail lights project rearward from the main body portion. The first simulated tail light is closer to the handle than the second simulated tail light.

4 Claims, 2 Drawing Sheets

FIG 3
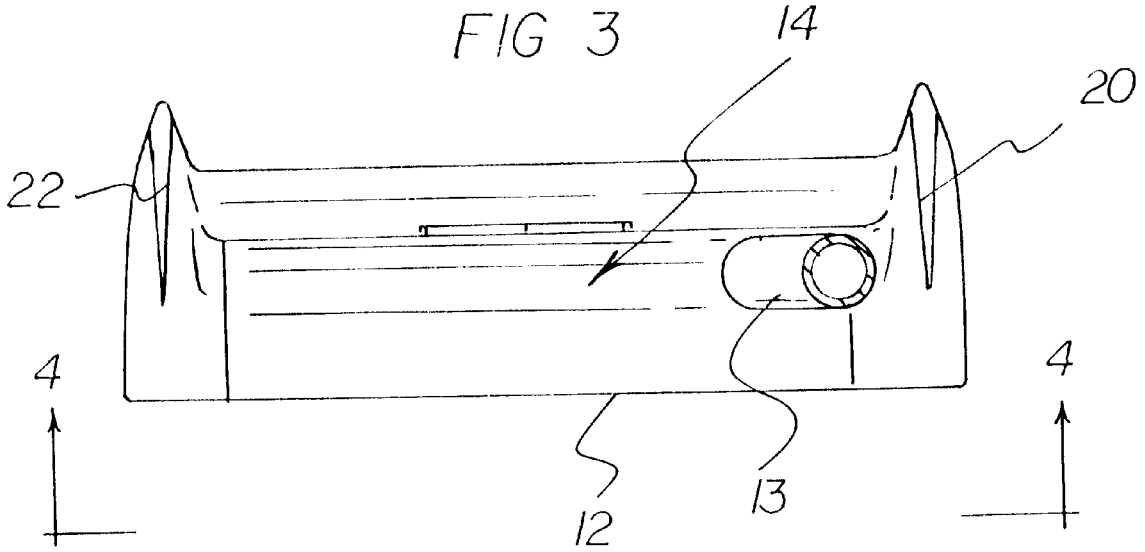
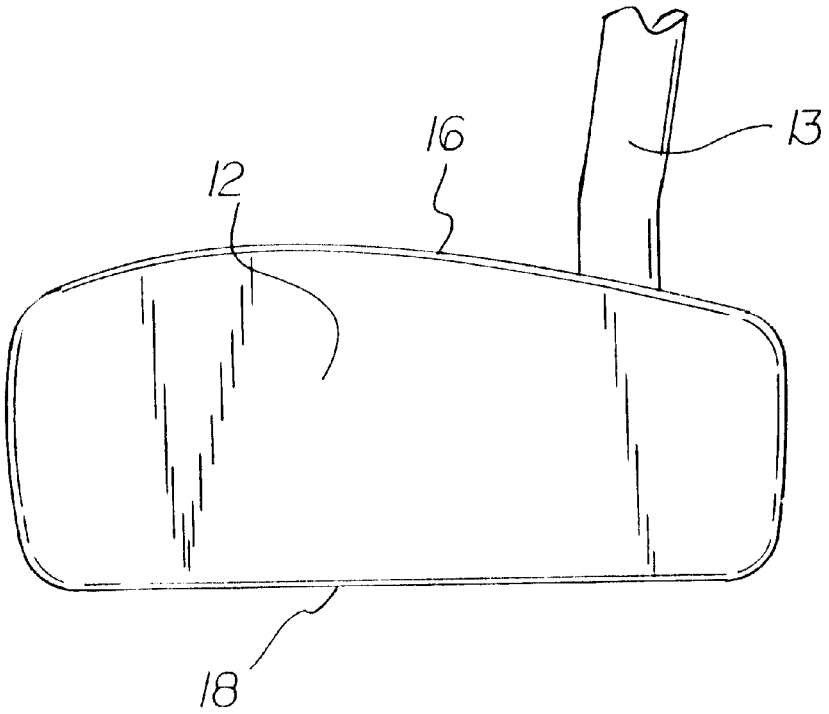
FIG 4

GOLF CLUB HEAD APPARATUS

CROSS-REFERENCE TO RELATED APPLICATION

This application claims priority based upon my prior copending Provisional Application Ser. No. 60/058,496, filed Sep. 11, 1997.

BACKGROUND OF THE INVENTION

1. Field of the Invention

The present invention relates generally to the sport of golf and, more particularly, to golf clubs.

2. Description of the Prior Art

In general, a golf club has a club handle and a club head. The club head has both ornamental and functional design characteristics. Throughout the years, a number of innovations have been developed relating to both ornamental and functional club head designs, and the following U.S. patents are representative of some of those innovations: U.S. Pat. No. Des. 274,448, U.S. Pat. No. Des. 326,887, U.S. Pat. No. Des. 360,008, U.S. Pat. No. Des. 367,095, and U.S. Pat. No. Des. 367,691. More specifically, U.S. Pat. No. Des. 274,448 a golf putter head shaped like a human foot. U.S. Pat. No. Des. 326,887 discloses a golf putter that resembles plumbing pipes and a valve. U.S. Pat. No. Des. 360,008 discloses a golf putter head that resembles a housing member for a gear shift lever. U.S. Pat. No. Des. 367,095 discloses a novelty golf putter that includes a simulated horn. Also, U.S. Pat. No. Des. 367,691 discloses another golf putter head. In view of the above, it is noted that none of the golf clubs disclosed in the patents cited above disclose a golf club head that resembles either a rear portion or a front portion of an automobile. In this respect, it would be desirable if a golf club head had the ornamental appearance of either the rear portion or the front portion of an automobile.

Both the rear portion and the front portion of an automobile have functional as well as ornamental characteristics. With respect to functional characteristics, both the rear and front portions of an automobile have air foil surfaces that have functional aerodynamic characteristics. In this respect, it would be desirable if a golf club head had air foil surfaces similar to air foil surfaces of an automobile.

Thus, while the foregoing body of prior art indicates it to be well known to have golf club heads with functional and ornamental design characteristics, the prior art described above does not teach or suggest a golf club head apparatus which has the following combination of desirable features: (1) has the ornamental appearance of either the rear portion or the front portion of an automobile; and (2) has air foil surfaces similar to air foil surfaces of an automobile. The foregoing desired characteristics are provided by the unique golf club head apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a golf club head apparatus which includes a ball-striker face portion and a main body portion underlying the ball-striker face portion. The main body portion includes a top body surface and a bottom body surface, and the main body portion includes air foil surfaces which project upward from the top body surface. The air foil surfaces include a first air foil surface and a second air foil surface. A handle is connected to the main body portion. The handle enters the main body portion through the top body surface which can be a simulated trunk lid. The handle is closer to the first air foil surface than to the second air foil surface. With the handle present, a complete golf club is provided. Generally, the main body portion has a configuration which simulates a rear portion of an automobile. Alternatively, the main body portion has a configuration which simulates a front portion of an automobile. The ball-striker face portion can be in a form of an automobile rear view mirror.

The first air foil surface is a simulated automobile first tail fin surface, and the second air foil surface is a simulated automobile second tail fin surface. Simulated exhaust pipes project rearward from the main body portion. The simulated exhaust pipes include a first simulated exhaust pipe and a second simulated exhaust pipe. The first simulated exhaust pipe is closer to the handle than the second simulated exhaust pipe. A simulated trunk lid is located between the first air foil surface and the second air foil surface on the main body portion. Simulated tail lights project rearward from the main body portion. The simulated tail lights include a first simulated tail light and a second simulated tail light. The first simulated tail light is closer to the handle than the second simulated tail light. The main body portion can be shaped as a head for a putter.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf club head apparatus which has all of the advantages of the prior art and none of the disadvantages.

It is another object of the present invention to provide a new and improved golf club head apparatus which may be easily and efficiently manufactured and marketed.

It is a further object of the present invention to provide a new and improved golf club head apparatus which is of durable and reliable construction.

An even further object of the present invention is to provide a new and improved golf club head apparatus which is susceptible of a low cost of manufacture with regard to both materials and labor, and which accordingly is then susceptible of low prices of sale to the consuming public, thereby making such golf club head apparatus available to the buying public.

Still yet a further object of the present invention is to provide a new and improved golf club head apparatus which has the ornamental appearance of either the rear portion or the front portion of an automobile.

Still another object of the present invention is to provide a new and improved golf club head apparatus that has air foil surfaces similar to air foil surfaces of an automobile.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a cross-sectional view of the embodiment of the golf club head apparatus of FIG. 2 taken along line 3—3 thereof.

FIG. 4 is a front view of the portion of the embodiment of the invention shown in FIG. 3 taken along line 4—4 thereof.

DESCRIPTION OF THE PREFERRED EMBODIMENT

With reference to the drawings, a new and improved golf club head apparatus embodying the principles and concepts of the present invention will be described.

Figure 1:
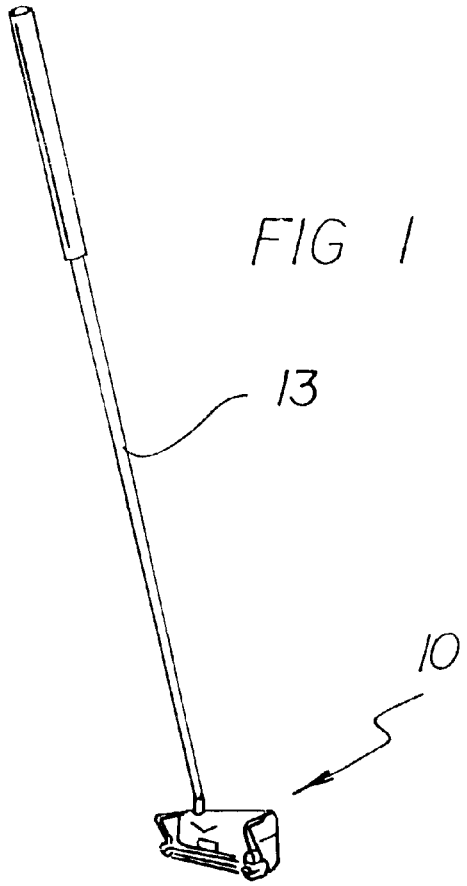
FIG. 1 is a perspective view showing a preferred embodiment of the golf club head apparatus of the invention.
Figure 2:
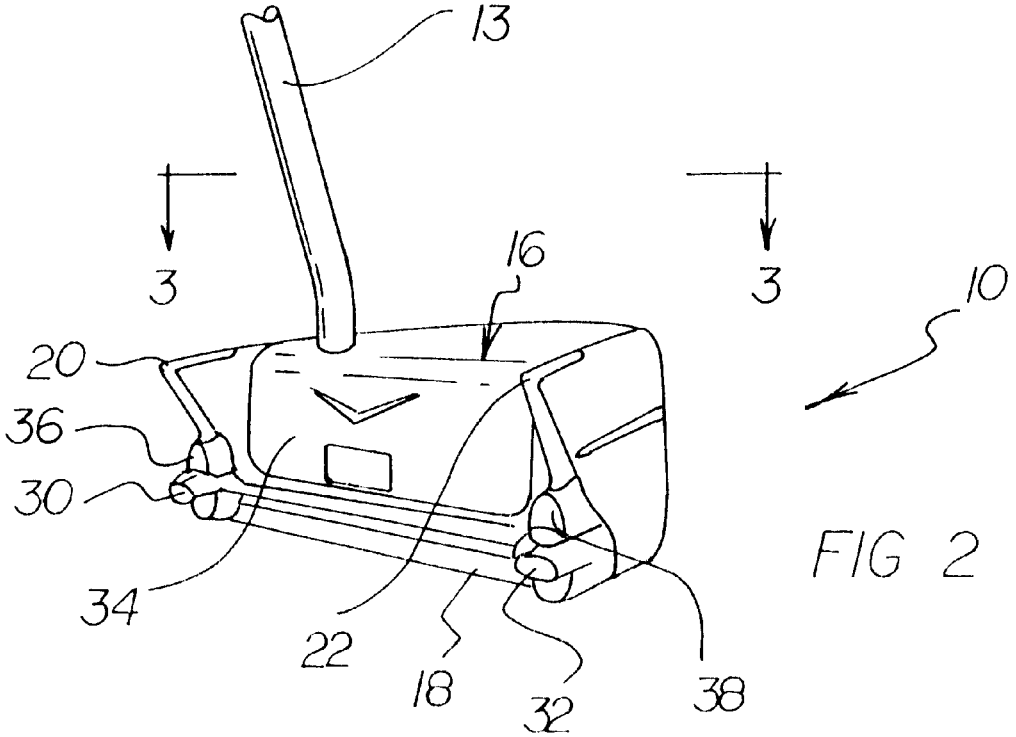
FIG. 2 is an enlarged perspective view of the head portion of the golf club head apparatus shown in FIG. 1.

Turning to FIGS. 1–4, there is shown an exemplary embodiment of the golf club head apparatus of the invention generally designated by reference numeral 10. In its preferred form, golf club head apparatus 10 includes a ball-striker face portion 12 and a main body portion 14 underlying the ball-striker face portion 12. The main body portion 14 includes a top body surface 16 and a bottom body surface 18, and the main body portion 14 includes air foil surfaces which project upward from the top body surface 16. The air foil surfaces include a first air foil surface 20 and a second air foil surface 22. A handle 13 is connected to the main body portion 14. The handle 13 enters the main body portion 14 through the top body surface 16, shown in the figures as the trunk lid. The handle 13 is closer to the first air foil surface 20 than to the second air foil surface 22. With the handle 13 present, a complete golf club is provided.

The first air foil surface 20 is a simulated automobile first tail fin surface, and the second air foil surface 22 is a simulated automobile second tail fin surface. Simulated exhaust pipes project rearward from the main body portion 14. The simulated exhaust pipes include a first simulated exhaust pipe 30 and a second simulated exhaust pipe 32. The first simulated exhaust pipe 30 is closer to the handle 13 than the second simulated exhaust pipe 32. A simulated trunk lid 34 is located between the first air foil surface 20 and the second air foil surface 22 on the main body portion 14. Simulated tail lights project rearward from the main body portion 14. The simulated tail lights include a first simulated tail light 36 and a second simulated tail light 38. The first simulated tail light 36 is closer to the handle 13 than the second simulated tail light 38.

Generally, the main body portion 14 has a configuration which simulates a rear portion of an automobile. Alternatively, the main body portion 14 has a configuration which simulates a front portion of an automobile.

In general, the automobiles that are simulated can be classic automobiles. For example, FIGS. 1–4 illustrated the rear portion of a simulated 1957 Chevrolet automobile. The main body portion 14 is shaped as a head for a putter.

The components of the golf club head apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved golf club head apparatus that is low in cost, relatively simple in design and operation, and which has the ornamental appearance of either the rear portion or the front portion of an automobile. With the invention, a golf club head apparatus is provided which has air foil surfaces similar to air foil surfaces of an automobile.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A golf club apparatus, comprising:

a main body portion, said main body portion having a top surface, a bottom surface, first and second side surfaces and first and second end surfaces, said first end surface comprising a substantially flat ball-striker face, at least said second end face, said first and second side surfaces and said top surface being configured in such a way as to simulate a portion of an automotive vehicle extending from said ball-striker face, said top surface of said main body portion being shaped to give said top surface the appearance of the trunk lid of said automotive vehicle, said first and second side surfaces of said main body portion being shaped to give said side surfaces the appearance of the rear fender portions of said automotive vehicle, and said rear surface of said main body portion being shaped to give said rear surface the appearance of the rear end surface of said automotive vehicle, said rear surface including shaped portions having the appearance of a portion of said vehicle's trunk lid, and additional shaped portions having the appearance of said vehicles's taillight assemblies, rear bumper assembly and at least one exhaust pipe, and a handle, said handle being connected to said top surface of said main body portion to form a complete golf club apparatus.

2. The apparatus of claim 1 wherein said rear fender portions include rearward extending tail fins which serve the dual purpose of functioning as air foil stabilizers for said golf club apparatus.

3. The apparatus of claim 2 wherein said automotive vehicle is a 1957 Chevrolet automobile.

4. The apparatus of claim 1 wherein said first end surface forming said ball-striker surface has a substantially rectangular shape with rounded corners to thereby simulate the shape of said automotive vehicle's rear view mirror.

* * * * *